US011518170B2

(12) United States Patent
Toshishige et al.

(10) Patent No.: US 11,518,170 B2
(45) Date of Patent: Dec. 6, 2022

(54) METHOD OF MANUFACTURING LIQUID DISCHARGE HEAD AND LIQUID DISCHARGE HEAD IN WHICH A PLURALITY OF SUBSTRATES INCLUDING A LIQUID FLOW PASSAGE ARE SATISFACTORILY STUCK TOGETHER WITH AN ADHESIVE AGENT

(71) Applicant: CANON KABUSHIKI KAISHA, Tokyo (JP)

(72) Inventors: Mitsunori Toshishige, Kawasaki (JP); Souta Takeuchi, Fujisawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 10 days.

(21) Appl. No.: 16/842,329

(22) Filed: Apr. 7, 2020

(65) Prior Publication Data

US 2020/0338892 A1 Oct. 29, 2020

(30) Foreign Application Priority Data

Apr. 24, 2019 (JP) ..... JP2019-083123

(51) Int. Cl.
*B41J 2/16* (2006.01)
*B41J 2/14* (2006.01)

(52) U.S. Cl.
CPC ..... *B41J 2/1623* (2013.01); *B41J 2/14* (2013.01); *B41J 2/1629* (2013.01)

(58) Field of Classification Search
CPC . B41J 2/1623; B41J 2/14; B41J 2/1629; B41J 2/1631; B41J 2/1634; B41J 2/1628; B41J 2/1603
See application file for complete search history.

(56) References Cited

U.S. PATENT DOCUMENTS

2011/0012960 A1* 1/2011 Sakuma ..... B41J 2/14129 347/44

FOREIGN PATENT DOCUMENTS

JP 2018083365 A 5/2018

OTHER PUBLICATIONS

IP.com search (Year: 2021).*

* cited by examiner

*Primary Examiner* — Lisa Solomon
(74) *Attorney, Agent, or Firm* — Canon U.S.A., Inc., IP Division

(57) ABSTRACT

A method of manufacturing a liquid discharge head includes preparing a first substrate where a discharge port configured to discharge liquid is formed to face a first surface, a concave portion is formed on a side of a second surface opposite to the first surface, and a first liquid flow passage penetrating from the first surface to the second surface is opened inside the concave portion on the side of the second surface, preparing a second substrate including a second liquid flow passage opened on a third surface, and sticking the first substrate and the second substrate to communicate the first liquid flow passage with the second liquid flow passage by bonding a bottom face of the concave portion and the third surface with an adhesive agent.

17 Claims, 6 Drawing Sheets

METHOD OF MANUFACTURING LIQUID DISCHARGE HEAD AND LIQUID DISCHARGE HEAD IN WHICH A PLURALITY OF SUBSTRATES INCLUDING A LIQUID FLOW PASSAGE ARE SATISFACTORILY STUCK TOGETHER WITH AN ADHESIVE AGENT

BACKGROUND OF THE DISCLOSURE

Field of the Disclosure

The present disclosure relates to a method of manufacturing a liquid discharge head and the liquid discharge head.

Description of the Related Art

A liquid discharge apparatus such as an ink jet printer includes a liquid discharge head configured to discharge liquid (ink). An example of such a liquid discharge head includes a liquid discharge head including a substrate in which a plurality of substrates is stuck together.

Japanese Patent Application Laid-Open No. 2018-83365 discusses a liquid discharge head in which a first substrate (recording element substrate) and a second substrate (support member) are stuck together. A discharge port configured to discharge liquid is formed on a side of a first surface of the first substrate. The first substrate includes a first liquid flow passage (supplying port) penetrating through the first surface and a second surface opposite to the first surface. A second liquid flow passage is opened on a third surface (a surface on the side of the first substrate) of the second substrate. The first substrate and the second substrate are stuck together by bonding the second surface and the third surface with an adhesive agent.

In the liquid discharge head as discussed in Japanese Patent Application Laid-Open No. 2018-83365, the second surface of the first substrate is stuck to the second substrate. In a process of manufacturing the liquid discharge head, the second surface may come into contact with a component of a manufacturing apparatus (a substrate suction stage of an exposure apparatus or a laminating apparatus, an electrostatic chuck of a substrate joining apparatus, or the like). Thus, the second surface may be contaminated by deposit adhering to the component of the manufacturing apparatus.

In a case where the second surface of the first substrate and the third surface of the second substrate are to be bonded with an adhesive agent in a state where the deposit adheres to the second surface as described above, adhesion between the second surface and the third surface may not be satisfactory due to the deposit. If the adhesion is not satisfactory, a gap is formed between the second surface and the third surface. On the second surface, the first liquid flow passage is opened. Therefore, if an opening of the first liquid flow passage communicates with the gap, the liquid may leak from the gap. If the liquid leaks, the liquid may flow out of the liquid discharge head, or the liquid may flow out into an adjacent liquid flow passage, causing color mixture of the liquid or the like.

SUMMARY OF THE DISCLOSURE

According to an aspect of the present disclosure, a method of manufacturing a liquid discharge head includes preparing a first substrate where a discharge port configured to discharge liquid is formed to face a first surface, a concave portion is formed on a side of a second surface opposite to the first surface, and a first liquid flow passage penetrating from the first surface to the second surface is opened inside the concave portion on the side of the second surface, preparing a second substrate including a second liquid flow passage opened on a third surface, and sticking the first substrate and the second substrate to communicate the first liquid flow passage with the second liquid flow passage by bonding a bottom face of the concave portion and the third surface with an adhesive agent.

Further features and aspects of the present disclosure will become apparent from the following description of example embodiments with reference to the attached drawings.

DESCRIPTION OF THE EMBODIMENTS

The present disclosure provides a liquid discharge head in which a plurality of substrates including a liquid flow passage are satisfactorily stuck together with an adhesive agent.

Below, some example embodiments according to the present disclosure will be described with reference to the drawings. The liquid discharge head according to the present disclosure can be applied to a facsimile including a communication system, a word processor or a portable device including a printer unit, an industrial apparatus complexly combined with various processing devices, and the like, in addition to a printer and a copying machine. The liquid discharge head according to the present disclosure can also be applied to a modeling device such as a three-dimensional (3D) printer, a semiconductor manufacturing apparatus, and a medical apparatus. An object to which liquid is discharged can have a two-dimensional structure or a three-dimensional structure, and the liquid can be discharged to space. Below, an ink jet head for discharging ink, which is used in an ink jet printer, will be described as an example of a liquid discharge head.

Figure 1A:
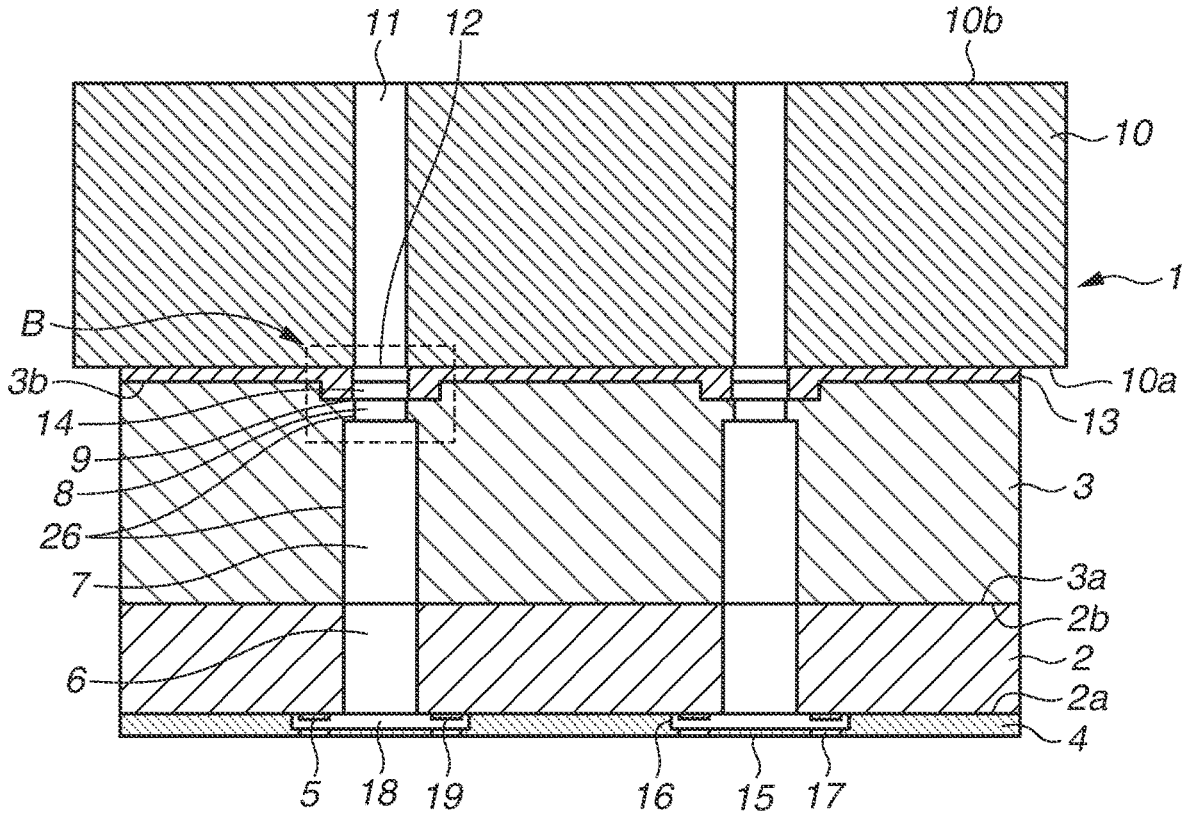
FIGS. 1A and 1B are schematic cross-sectional views of an example liquid discharge head.
Figure 1B:
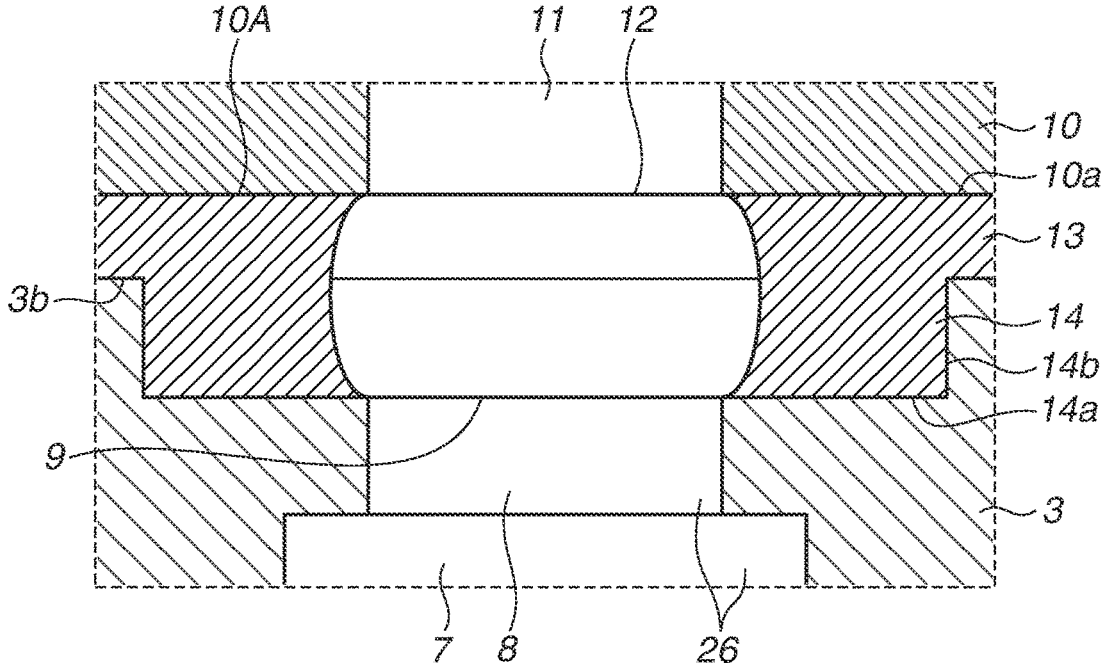
Figure 2:
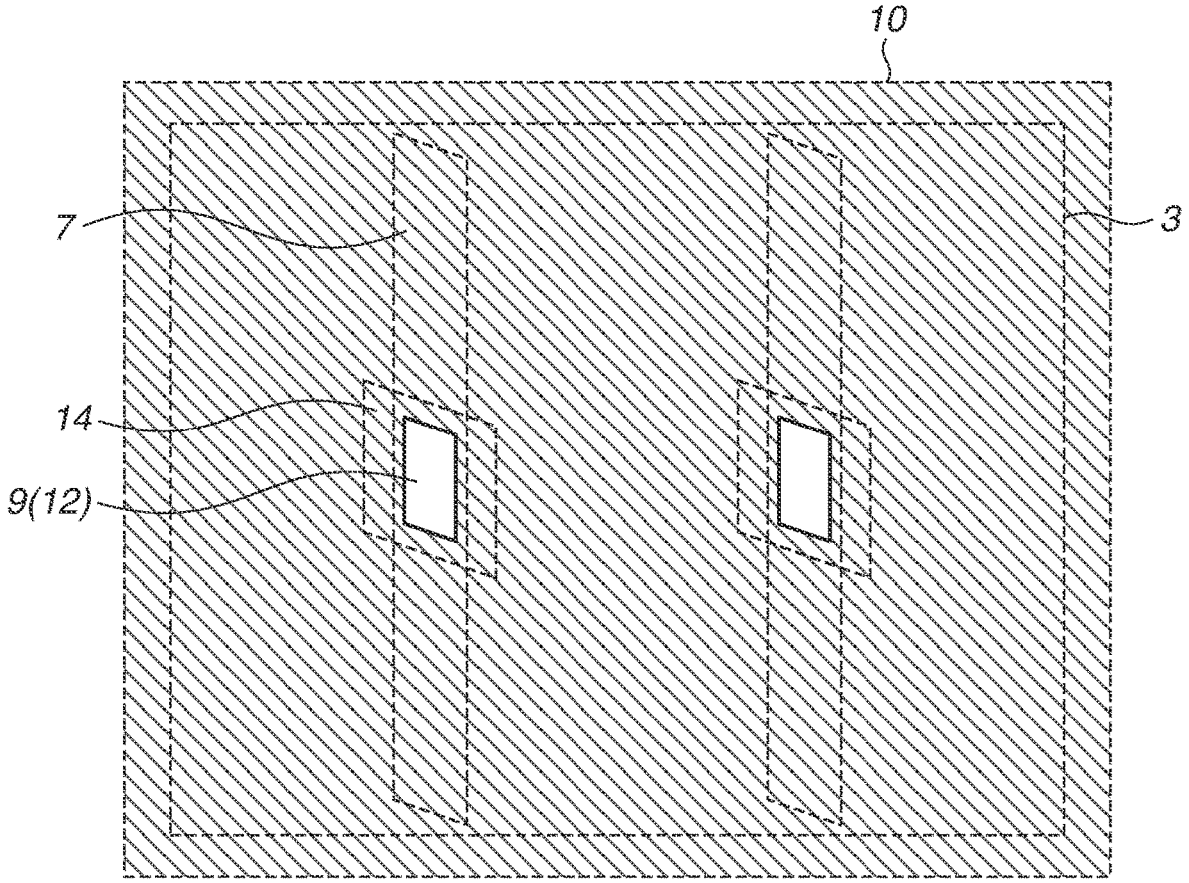
FIG. 2 is a schematic plan view of the liquid discharge head.

FIG. 1A is a cross-sectional view schematically illustrating a liquid discharge head 1 according to an example embodiment of the present disclosure, and FIG. 1B is a cross-sectional view illustrating an enlarged view of a portion B in FIG. 1A. FIG. 2 is a schematic plan view of the liquid discharge head 1 illustrated in FIGS. 1A and 1B as viewed from a side of a second substrate 10. However, for convenience, the second substrate 10 and a second liquid flow passage 11, and a first substrate 3, a first liquid flow passage 26, and a concave portion 14 are illustrated on the same plane. Further, for convenience, FIG. 2 does not illustrate a third substrate 2 and a structure and an adhesive agent 13 formed on the first substrate 3.

The liquid discharge head 1 includes the first substrate 3 and the second substrate 10 bonded to the first substrate 3 with the adhesive agent 13. A discharge port 17 configured to discharge liquid is formed to face a first surface 3*a* of the first substrate 3. The concave portion 14 is formed on a side of a second surface 3*b* opposite to the first surface 3*a* of the first substrate 3. The first substrate 3 is formed with the first liquid flow passage 26 penetrating from the first surface 3*a* to the second surface 3*b*, and an opening 9 of the first liquid flow passage 26 is opened inside the concave portion 14 of the second surface 3*b*. The first liquid flow passage 26 includes a first portion 7 on a side of the first surface 3*a* and a second portion 8 on a side of the second surface 3*b*. Here, the shape of the opening 9 is a parallelogram as illustrated in FIG. 2, but can be a square, a rectangle, a polygon, or a circle. On the first substrate 3, an insulation layer, a protective layer, an adhesion improving layer, a flattening layer, an antireflection layer, a chemical resistant layer, and the like can be formed. A silicon substrate formed of silicon is desirably employed for the first substrate 3 from the viewpoint of processability. In particular, a single crystal silicon substrate is desirably employed.

The second substrate 10 includes a third surface 10*a* and a fourth surface 10*b* opposite to the third surface 10*a*. The second substrate 10 is formed with the second liquid flow passage 11 penetrating from the third surface 10*a* to the fourth surface 10*b*. Therefore, an opening 12 of the second liquid flow passage 11 is opened on the third surface 10*a*. The second liquid flow passage 11 communicates with the first liquid flow passage 26. Here, the shape of the opening 12 is a parallelogram as illustrated in FIG. 2, but can be a square, a rectangle, a polygon, or a circle. The second substrate 10 is desirably a substrate formed of alumina from the viewpoint of heat dissipation, insulation, and mechanical strength.

The second surface 3*b* of the first substrate 3 and the third surface 10*a* of the second substrate 10 are bonded with the adhesive agent 13. Examples of the adhesive agent 13 include a thermosetting adhesive agent and a photocurable adhesive agent, and more specifically, an epoxy resin to which a curing agent is added.

In the example illustrated in FIG. 1A, the third substrate 2 and a flow passage forming member 4 are provided between the first substrate 3 and the discharge port 17. The third substrate 2 is formed on the first surface 3*a* of the first substrate 3. On a surface 2*a* of the third substrate 2, an energy generating element 5 configured to apply energy for discharging liquid, a driving circuit (not illustrated) for the energy generating element 5, a connection terminal (not illustrated), and the like are formed. Examples of the energy generating element 5 include a heating resistance element employing a TaSiN film, a piezoelectric element, and a vibration plate. The number of energy generating elements 5 is not limited, and a plurality of energy generating elements 5 can be arranged at predetermined intervals. Further, on the third substrate 2, an insulation layer, a protective layer, an adhesion improving layer, a flattening layer, an antireflection layer, a chemical resistant layer, and the like can be formed. A silicon substrate formed of silicon is desirably employed for the third substrate 2 from the viewpoint of processability and controllability of resistivity of the energy generating element, the driving circuit, and the like. In particular, a single crystal silicon substrate is desirably employed. The third substrate 2 is formed with a third liquid flow passage 6 penetrating the surface 2*a* and a surface 2*b*. The third liquid flow passage 6 communicates with the first liquid flow passage 26 and the second liquid flow passage 11, and opens between adjacent energy generating elements 5 on the surface 2*a*.

The flow passage forming member 4 includes a discharge port forming member 15 facing the surface 2*a* of the third substrate 2, and a side wall forming member 16 located between the discharge port forming member 15 and the surface 2*a* of the third substrate 2. The discharge port forming member 15 and the side wall forming member 16 can be integrally formed. The discharge port forming member 15 and the side wall forming member 16 can be formed of, for example, a photosensitive resin. The discharge port forming member 15 includes the discharge port 17 configured to discharge liquid. The discharge port forming member 15 forms a flow passage 18 and a pressure chamber 19 between the third substrate 2 and the discharge port forming member 15. The side wall forming member 16 is a member forming a side wall of the flow passage 18. The pressure chamber 19 includes the energy generating element 5, and the energy generating element 5 faces the discharge port 17. The flow passage 18 communicates with the third liquid flow passage 6, the pressure chamber 19, and the discharge port 17. Liquid supplied from the outside of the liquid discharge head 1 flows from the second liquid flow passage 11 of the second substrate 10 through the second portion 8 and the first portion 7 of the first liquid flow passage 26 of the first substrate 3 and is supplied to the third liquid flow passage 6 of the third substrate 2. The liquid is further supplied to the pressure chamber 19 through the flow passage 18, is applied with energy for discharge from the energy generating element 5, and is discharged from the discharge port 17.

The surface 2*b* of the third substrate 2 and the first surface 3*a* of the first substrate 3 are bonded with, for example, a resin material (not illustrated). Examples of such a resin material include a polyimide resin, a polyamide resin, an epoxy resin, a polycarbonate resin, an acrylic resin, and a fluororesin.

As described above, the concave portion 14 is formed on the side of the second surface 3*b* of the first substrate 3. The opening 9 of the first liquid flow passage 26 opens inside the concave portion 14 of the second surface 3*b*. That is, when the second surface 3*b* is viewed from a side opposite to the second surface 3*b*, an area of the concave portion 14 is larger than an area of the opening 9, and the opening 9 is included inside the concave portion 14. The concave portion 14 is formed at a position one step lower (recessed) from the second surface 3*b*, and includes a bottom face 14*a* extending along the second surface 3*b* and a lateral face 14*b* extending in a direction intersecting the bottom face 14*a*. Particularly, the bottom face 14*a* of the concave portion 14 is located at a position recessed from the second surface 3*b* (deep side). Therefore, even if the second surface 3*b* comes into contact with a component of the manufacturing apparatus, the bottom face 14*a* hardly comes into contact with a component. Thus, deposit derived from a component and the like hardly adheres to the concave portions 14. The first substrate 3 and the second substrate 10 are stuck together with the adhesive agent 13. The adhesive agent 13 bonds the second surface 3*b* and the third surface 10*a*, and further, the bottom face 14*a* of the concave portion 14 and the third surface 10*a*, and the adhesive agent 13 enters the concave portion 14. There is an area inside the concave portion 14 where the adhesive agent 13 does not partially exist to allow the first liquid flow passage 26 and the second liquid flow passage 11 to be communicated with each other. As described above, the bottom face 14*a* of the concave portion 14 does not easily come into contact with a component of the manufacturing apparatus, and thus, deposit hardly adheres to the bottom face 14*a* of the concave portion 14. Therefore, the first substrate 3 and the second substrate 10 can be satisfactorily bonded by being bonded with the adhesive agent 13 on the bottom face 14*a*. In particular, the first liquid flow passage 26 and the second liquid flow passage 11 are communicated at the concave portion 14. Thus, the adhesiveness is enhanced at a portion where the first liquid flow passage 26 and the second liquid flow passage 11 are communicated to prevent a gap from being generated between the second surface 3*b* and the third surface 10*a*, and thus, an outflow of liquid can be suppressed.

As described above, when the second surface 3*b* is viewed from the side opposite to the second surface 3*b*, the area of the concave portion 14 is larger than the area of the opening 9, and the opening 9 is included inside the concave portion 14. The concave portion 14 is filled with the adhesive agent 13. The opening 9 is a portion where the first liquid flow passage 26 and the second liquid flow passage 11 are communicated, so that the adhesive agent 13 should not block the opening 9. Thus, a distance (shortest distance) from an end of an opening area of the opening 9 to the lateral face 14*b* of the concave portion 14 is desirably 100 μm or more. At any end of the opening area of the opening 9, the distance to the lateral face 14*b* of the concave portion 14 is desirably 100 μm or more. If the distance is too long, however, the concave portion 14 becomes too large. Therefore, the distance from the end of the opening area of the opening 9 to the lateral face 14*b* of the concave portion 14 is desirably 500 μm or less.

To prevent deposit from adhering, a depth of the concave portion 14 (a length of the concave portion 14 in an up-down direction in FIGS. 1A and 1B) is desirably 3 μm or more. However, the depth of the concave portion 14 is desirably 50 μm or less so that the adhesive agent 13 reaches the bottom face 14*a* to suppress the outflow of liquid.

The adhesive agent 13 bonds the bottom face 14*a* of the concave portion 14 and the third surface 10*a*. To further suppress the outflow of liquid, the adhesive agent 13 bonding the bottom face 14*a* of the concave portion 14 and the third surface 10*a* desirably further adheres (contacted) to the lateral face 14*b* of the concave portion 14.

Figure 3A:
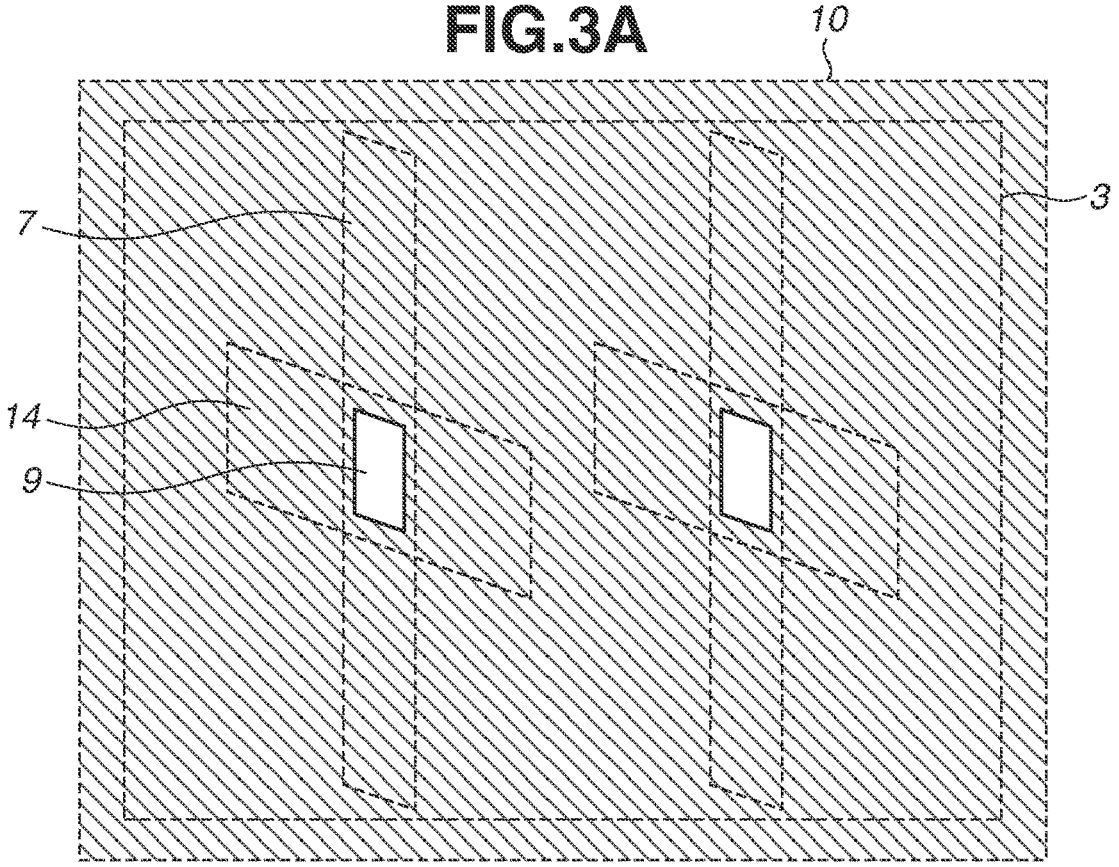
FIGS. 3A and 3B are schematic plan views of the liquid discharge head.
Figure 3B:
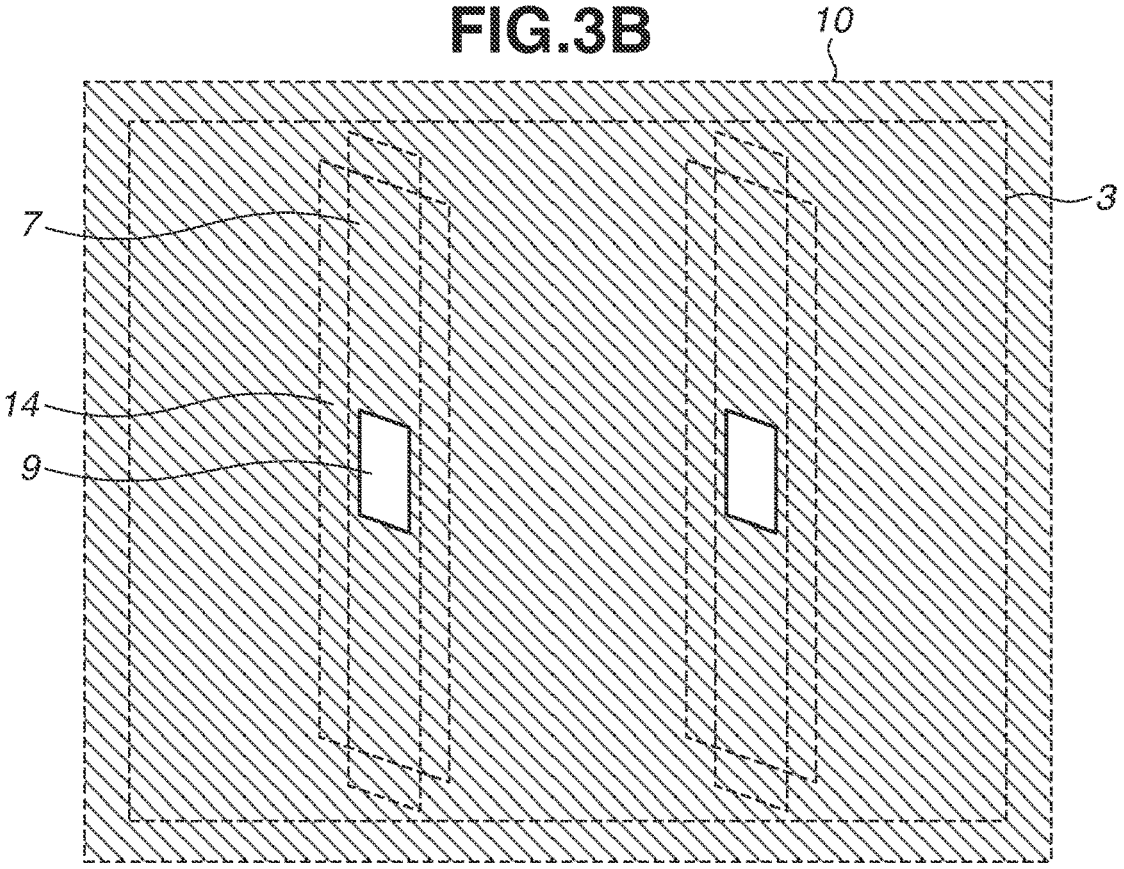

Similarly to FIG. 2, FIGS. 3A and 3B are schematic plan views of the liquid discharge head 1 as viewed from the side of the second substrate 10. In FIG. 3A, an opening width of the concave portion 14 is increased in a direction intersecting an extending direction of the first portion 7 (direction in which an adjacent first portion 7 is located), as compared to FIG. 2. In FIG. 3B, the opening width of the concave portion 14 is increased in the extending direction of the first portion 7, as compared to FIG. 2. In any cases, the increase of the opening width of the concave portion 14 makes an area of the bottom face 14*a*, to which the deposit hardly adheres, to expand. That is, a bonding area of the adhesive agent 13 and the bottom face 14*a* increases, and the liquid further hardly flows out. In FIG. 3A, the opening width of the concave portion 14 is desirably 1.5 times or more and 5.0 times or less an opening width of the opening 9 in the direction intersecting the extending direction of the first portion 7. In FIG. 3B, the opening width of the concave portion 14 is desirably 2.0 times or more and 10.0 times or less the opening width of the opening 9 in the extending direction of the first portion 7. FIGS. 3A and 3B illustrate the shape of the concave portion 14 being a parallelogram, but the shape can be a square, a rectangle, a polygon, or a circle.

Figure 6A:
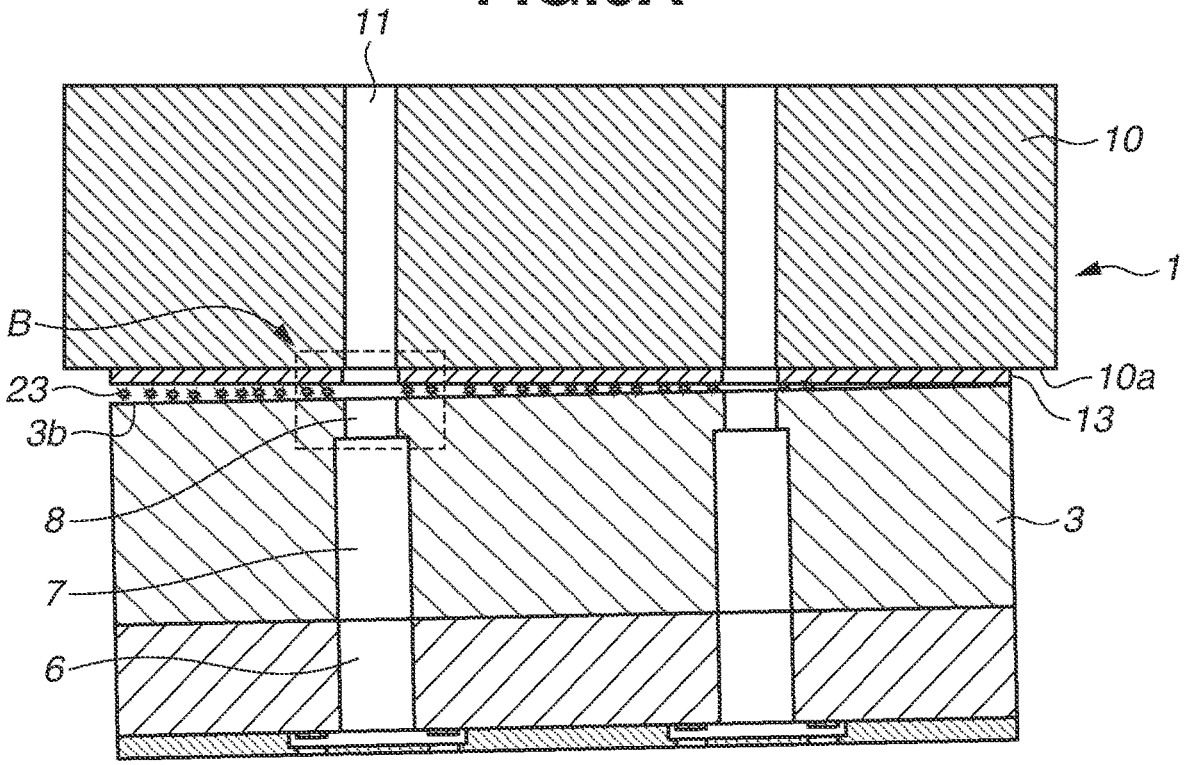
FIGS. 6A and 6B are schematic cross-sectional views of a liquid discharge head according to a comparative example embodiment.
Figure 6B:
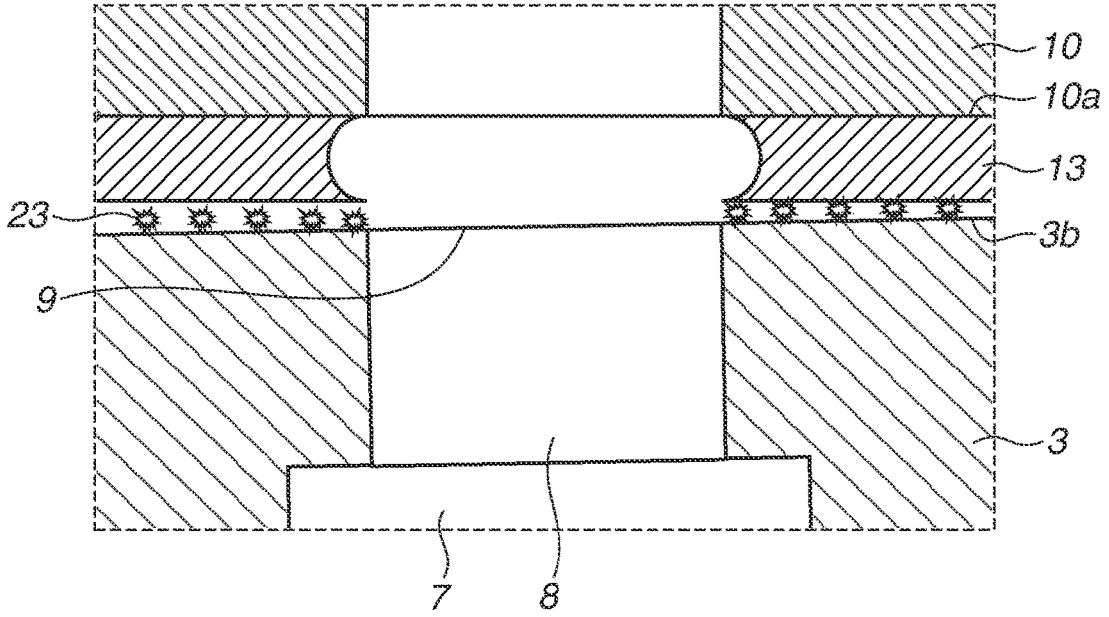

FIGS. 6A and 6B illustrate a liquid discharge head according to a comparative example embodiment. FIG. 6A is a cross-sectional view of the liquid discharge head, and FIG. 6B is a cross-sectional view illustrating an enlarged view of a portion B in FIG. 6A. In the liquid discharge head illustrated in FIGS. 6A and 6B, the concave portion 14 described in FIG. 1 is not formed on the side of the second surface 3*b* of the first substrate 3. In addition, FIGS. 6A and 6B illustrate peeled-off portions 23 of the adhesive agent 13 caused by deposit. Other configurations are the same as those of the liquid discharge head 1 described in FIG. 1, therefore the description thereof will be omitted. As illustrated in FIGS. 6A and 6B, the adhesive agent 13 needs to bond the first substrate 3 and the second substrate 10 only on the second surface 3*b* and the third surface 10*a*. Deposit adheres to the second surface 3*b*. Thus, the peeled-off portions 23 occur, and the first substrate 3 and the second substrate 10 are separated. If such separation occurs, the liquid may flow out.

A method of manufacturing the liquid discharge head 1 illustrated in FIG. 1 will be described with reference to FIGS. 4A to 4L. An order of steps illustrated in FIGS. 4A to 4L is not limited to the order described below.

Figure 4A:
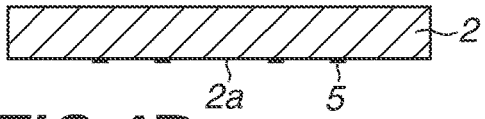
FIGS. 4A, 4B, 4C, 4D, 4E, 4F, 4G, 4H, 4I, 4J, 4K, and 4L are schematic cross-sectional views illustrating an example method of manufacturing the liquid discharge head.
Figure 4B:
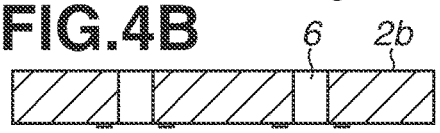

As illustrated in FIG. 4A, the third substrate 2 including the energy generating element 5 on the surface 2*a* is prepared. Here, an example is provided in which a heating resistance element made of TaSiN is employed for the energy generating element 5. In addition, an example is provided in which a silicon substrate made of single crystal silicon is employed for the third substrate 2. Then, as illustrated in FIG. 4B, the third substrate 2 is subjected to, for example, laser processing, reactive ion etching, sandblasting, or wet etching, to form the third liquid flow passage 6. Here, an example is provided in which a silicon substrate having a thickness of 300 μm and plane orientation (100) is subjected to reactive ion etching to form the third liquid flow passage 6.

Figure 4C:
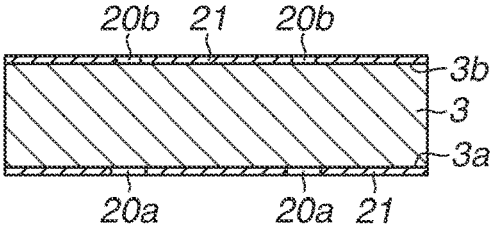
Figure 4D:
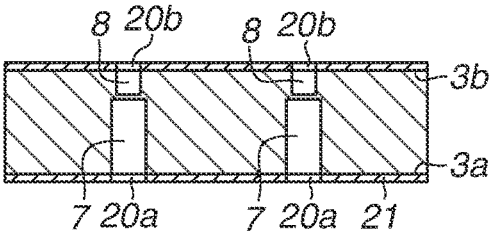

As illustrated in FIG. 4C, the first substrate 3 is prepared. Here, an example is provided in which a silicon substrate having a thickness of 600 μm and plane orientation (110) is employed. On the first surface 3*a* and the second surface 3*b* of the first substrate 3, a mask 21 including an opening 20*a* and an opening 20*b* is respectively provided. The mask 21 is formed of a thermal oxide film (silicon oxide film), a photoresist, or the like. Then, as illustrated in FIG. 4D, the first substrate 3 is processed using the mask 21. Examples of the processing includes laser processing, reactive ion etching, sandblasting, and wet etching. The first portion 7 is formed by processing the first substrate 3 from the opening 20*a*, and the second portion 8 is formed by processing the first substrate 3 from the opening 20*b*. These processing can be performed simultaneously. Here, an example is provided in which the first portion 7 and the second portion 8 are simultaneously processed (formed) by wet-etching (crystal anisotropic etching) the first substrate 3 using an aqueous solution of tetramethylammonium hydroxide. The processing is stopped before the first portion 7 and the second portion 8 communicate with each other. Thus, the concave portion 14 can be easily formed, as will be described below. The first portion 7 and the second portion 8 can have selectivity for the depth of the first portion 7 and the depth of the second portion 8, even if the first substrate 3 is processed from its both surfaces at the same time. For example, when the second portion 8 is formed by etching, an opening width of the opening 20*b* is defined so that a crystal orientation (11) of silicon is formed at a low etching rate to substantially stop the etching. Thus, the processing (etching)

for the first portion 7 can be continued while the processing (etching) in a depth direction of the second portion 8 is stopped in the etching process. That is, selectivity can be provided in an etching depth direction.

Figure 4E:
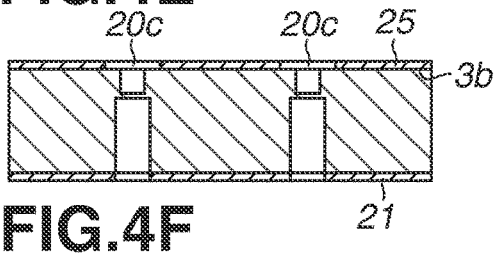

After stopping the processing for the first portion 7, as illustrated in FIG. 4E, a mask 25 including an opening 20*c* is provided on the second surface 3*b*. The mask 25 is formed by patterning a thermal oxide film (silicon oxide film) using a photoresist for a mask, for example. After the patterning, the photoresist is removed with hydrofluoric acid or the like.

Figure 4F:
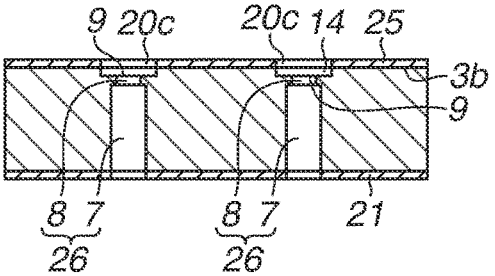
Figure 4G:
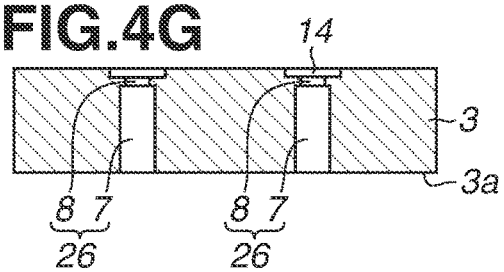

As illustrated in FIG. 4F, the concave portion 14 is formed on the second surface 3*b* by being processed from the opening 20*c*. The opening 9 of the first liquid flow passage 26 opens to the concave portion 14. The concave portion 14 is formed from the opening 20*c* by a method such as laser processing, reactive ion etching, sandblasting, or wet etching. For example, in a case of wet etching, etching proceeds not only from the side of the second surface 3*b* but also from the side of the first surface 3*a*. Thus, the first portion 7 and the concave portion 14 are simultaneously processed by etching so that the depths of the first portion 7 and the second portion 8 reach respective final target values. In this method, the processing of the concave portion 14 and an additional processing of the first portion 7 are performed at the same time, and thus, the time for wet etching can be reduced. Here, an example is provided in which the concave portion 14 is formed by wet etching (crystal anisotropic etching) the first substrate 3 using an aqueous solution of tetramethylammonium hydroxide. After the concave portion 14 is formed, the mask 21 and the mask 25 are removed with hydrofluoric acid or the like to obtain the first substrate 3 as illustrated in FIG. 4G.

Figure 4H:
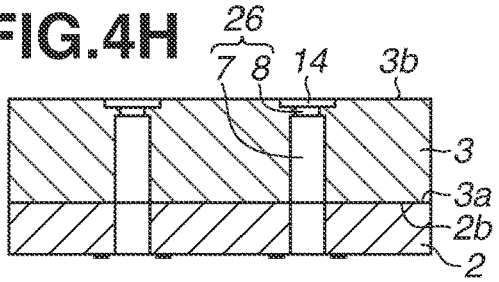

As illustrated in FIG. 4H, the surface 2*b* of the third substrate 2 and the first surface 3*a* of the first substrate 3 are bonded to stick the first substrate 3 and the third substrate 2. Examples of the bonding method include bonding using a resin material (for example, a thermosetting epoxy resin) or the like, and fusion bonding where activated surfaces are brought into contact with each other to proceed bonding spontaneously, eutectic bonding, diffusion bonding, and so on.

Figure 4I:
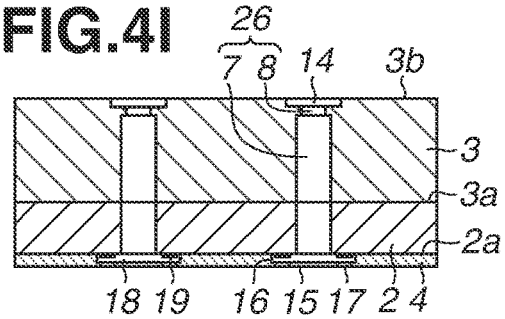

As illustrated in FIG. 4I, the flow passage forming member 4 including the discharge port 17 is formed on the surface 2*a* of the third substrate 2 (the surface opposite to the side where the first substrate 3 is located). The side wall forming member 16 and the discharge port forming member 15 including the discharge port 17 are formed in the flow passage forming member 4 by using, for example, photolithography. The flow passage 18 and the pressure chamber 19 are formed between the discharge port forming member 15 and the third substrate 2. Here, an example is provided in which the flow passage forming member 4 is formed of a negative photosensitive resin and patterned by photolithography.

The discharge port 17 configured to discharge liquid is formed to face the first surface 3*a* of the first substrate 3. The concave portion 14 is formed on the side of the second surface 3*b* of the first substrate 3. On the first substrate 3, the first liquid flow passage 26 penetrating from the first surface 3*a* to the second surface 3*b* is opened inside the concave portion 14 of the second surface 3*b*. The first substrate 3 as described above is prepared (a step of preparing a first substrate).

Figure 4J:
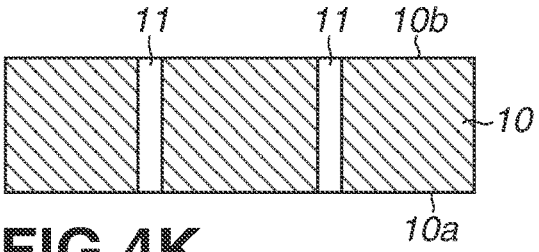

The second substrate 10 illustrated in FIG. 4J is prepared (a step of preparing a second substrate). The second substrate 10 includes the third surface 10*a* and the fourth surface 10*b* opposite to the third surface 10*a*. Further, the second substrate 10 is provided with the second liquid flow passage 11 penetrating from the third surface 10*a* to the fourth surface 10*b*. Alumina is employed for the second substrate 10, for example. Here, an example is provided in which alumina having a thickness of 1000 μm is employed for the second substrate 10.

Figure 4K:
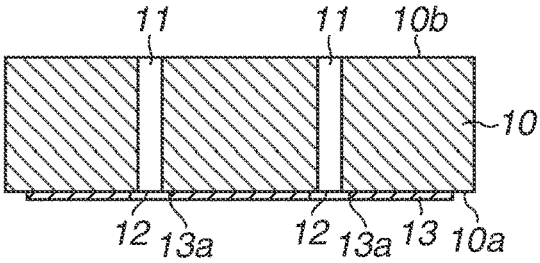

As illustrated in FIG. 4K, the adhesive agent 13 is formed on the third surface 10*a* of the second substrate 10. Examples of a method for forming the adhesive agent 13 include drawing application, dry film lamination, screen printing, and processing with a squeegee of the adhesive agent 13 on the third surface 10*a*. To ensure the fluidity of the liquid of the liquid discharge head 1, it is desirable to provide an area where the adhesive agent 13 is not formed at a position corresponding to the opening 12 opened on the third surface 10*a* of the second liquid flow passage 11. Here, an opening 13*a* is provided in a layer of the adhesive agent 13. Examples of the adhesive agent 13 include a thermosetting adhesive agent and a photocurable adhesive agent. An example is provided in which the adhesive agent 13 is formed on the third surface 10*a* of the second substrate 10, but the adhesive agent 13 can be formed on the second surface 3*b* of the first substrate 3.

Figure 4L:
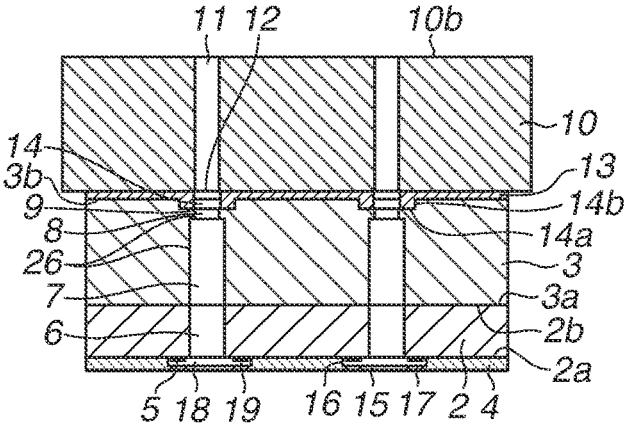

As illustrated in FIG. 4L, the second surface 3*b* of the first substrate 3 and the third surface 10*a* of the second substrate 10 are bonded with the adhesive agent 13 to stick the first substrate 3 and the second substrate 10 (a step of sticking the first substrate and the second substrate). At this time, the adhesive agent 13 is filled into the concave portion 14 and bonds the bottom face 14*a* of the concave portion 14 to the third surface 10*a*. The adhesive agent 13 also contacts with the lateral face 14*b* of the concave portion 14. However, there is a portion in the concave portion 14 (a portion corresponding to the above-described opening 13*a*) where the adhesive agent 13 does not exist so that the first liquid flow passage 26 and the second liquid flow passage 1 communicates with each other. An example of the method of filling the adhesive agent 13 into the concave portion 14 as described above includes a method of applying vibration in front and back and left and right directions while applying pressure to the first substrate 3 to cause the adhesive agent 13 to move to the lateral face 14*b* and the bottom face 14*a* of the concave portion 14. Also included is a method of filling the adhesive agent 13 by capillary phenomenon using the adhesive agent 13 having low viscosity. Here, an example is provided in which the flow passage forming member 4 is suctioned by a suction tool (not illustrated), and the second surface 3*b* of the first substrate 3 and the third surface 10*a* of the second substrate 10 fixed by a mechanical clamp (not illustrated) are brought into contact via the adhesive agent 13. After that, the second surface 3*b* and the third surface 10*a* are bonded by applying vibration in the front and back and left and right directions while applying pressure to the second substrate 10, and then the adhesive agent 13 is cured by heat treatment.

The electrical connection is performed at the end, and the liquid discharge head 1 is manufactured. In the liquid discharge head 1 manufactured in this manner, the bottom face 14*a* is bonded with the adhesive agent 13, and the first substrate 3 and the second substrate 10 are satisfactorily bonded. Since the first liquid flow passage 26 and the second liquid flow passage 11 are communicated at the concave portion 14, the outflow of liquid can be suppressed with the enhancement of the adhesiveness at this portion.

Another example of the method of manufacturing the liquid discharge head 1 will be described with reference to FIGS. 5A to 5D. FIGS. 5A to 5D are different in a method of manufacturing the first portion 7, the second portion 8, and the concave portion 14, from FIGS. 4D to 4F.

Figure 5A:
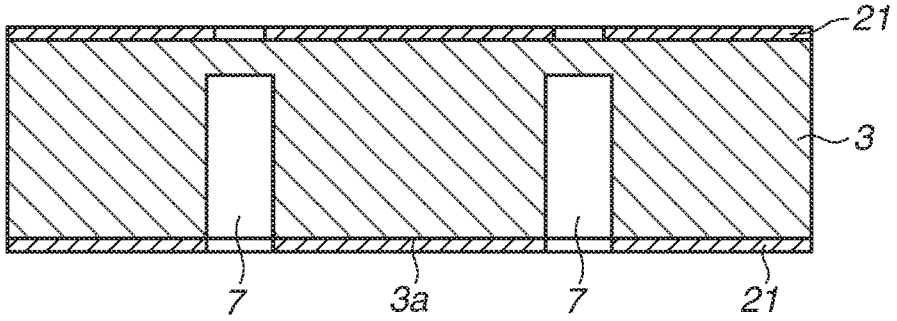
FIGS. 5A, 5B, 5C, and 5D are schematic cross-sectional views illustrating the method of manufacturing the liquid discharge head.

The steps before FIG. 5A are the same as the steps in FIGS. 4A to 4C. First, as illustrated in FIG. 5A, the first portion 7 is formed on the first substrate 3. The first portion 7 is formed, using the mask 21 on the first surface 3*a* of the first substrate 3, by being processed from an opening of the mask 21. The first portion 7 opens on the first surface 3*a* of the first substrate 3. Here, an example is provided in which the first portion 7 is formed by being processed based on a Bosch process using reactive ion etching. The Bosch process is a method of anisotropically etching silicon by alternately repeating formation of a protective film (not illustrated) mainly composed of carbon and etching with $SF_6$ gas or the like. After the etching, the protective film (not illustrated) in the Bosch process is removed with hydrofluoroether or the like.

Figure 5B:
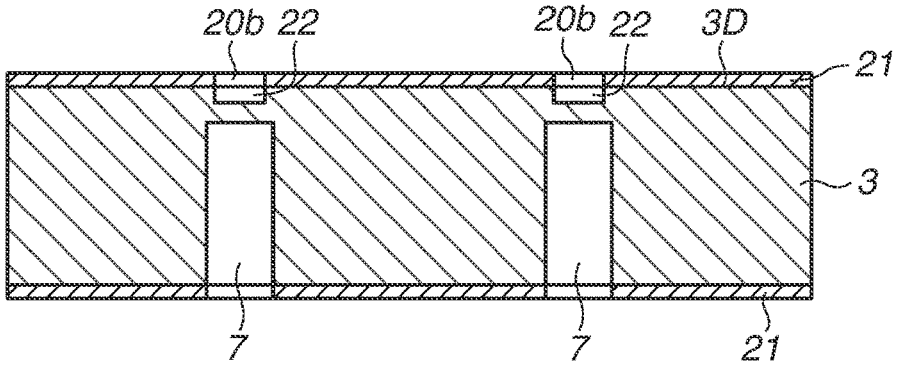

As illustrated in FIG. 5B, a leading hole 22 is formed on the first substrate 3 by being processed from the opening 20*b* of the mask 21 formed on the second surface 3*b*. The leading hole 22 is formed to have a width same as the width of the second portion 8 to be formed later. Although details will be described below, the formation of the leading hole 22 is a key point in a subsequent step of forming the concave portion 14 and the second portion 8. Here, an example is provided in which the leading hole 22 is formed by being processed based on the Bosch process using reactive ion etching. After the etching, the protective film (not illustrated) in the Bosch process is removed with hydrofluoroether or the like.

Figure 5C:
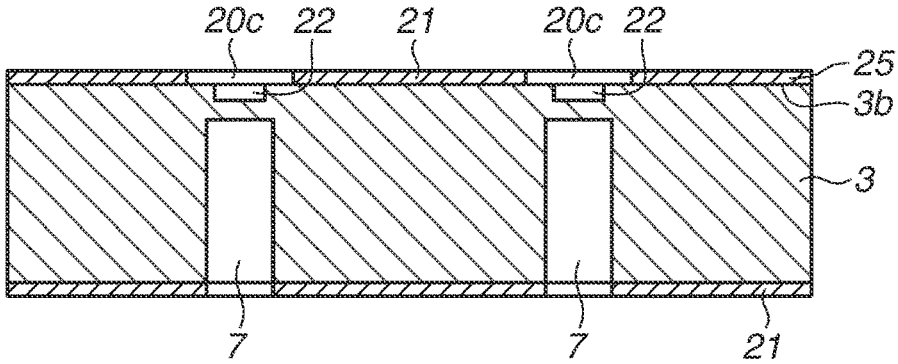

As illustrated in FIG. 5C, the mask 25 including the opening 20*c* is provided on the second surface 3*b*. The mask 25 is formed by patterning a thermal oxide film (silicon oxide film) using a photoresist for a mask, for example. After the patterning, the photoresist is removed with hydrofluoric acid or the like.

Figure 5D:
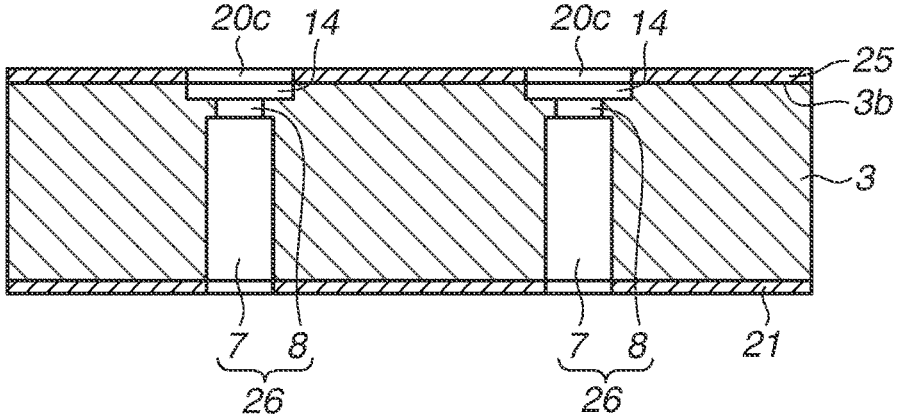

As illustrated in FIG. 5D, the concave portion 14 and the second portion 8 are simultaneously formed on the side of the second surface 3*b* of the first substrate 3. For example, the concave portion 14 and the second portion 8 are simultaneously formed by the forming method described with reference to FIG. 5A. When the concave portion 14 is formed by etching, the etching for the leading hole 22 proceeds simultaneously, and the second portion 8 is formed. That is, the leading hole 22 serves as a trigger, and the second portion 8 is formed by etching simultaneously with the concave portion 14 so that the depth of the second portion 8 reaches a target value. After the etching, the first portion 7 and the second portion 8 are in communication with each other to form the first liquid flow passage 26. In this manufacturing method, the concave portion 14 and the second portion 8 can be formed at the same time, so that the processing time can be reduced as compared with a case of separately forming the concave portion 14 and the second portion 8. After the etching, the protective film (not illustrated) in the Bosch process is removed with hydrofluoroether or the like.

The subsequent steps in the manufacturing method is the same as the steps illustrated in FIGS. 4G to 4L, and thus, the details are omitted. In the liquid discharge head 1 manufactured in this manner also, the bottom face 14*a* is bonded with the adhesive agent 13, and the first substrate 3 and the second substrate 10 are satisfactorily bonded. Therefore, the outflow of liquid can be suppressed.

While the present disclosure has been described with reference to example embodiments, it is to be understood that the disclosure is not limited to the disclosed example embodiments. The scope of the following claims is to be accorded the broadest interpretation so as to encompass all such modifications and equivalent structures and functions.

This application claims the benefit of Japanese Patent Application No. 2019-083123, filed Apr. 24, 2019, which is hereby incorporated by reference herein in its entirety.

What is claimed is:

1. A method of manufacturing a liquid discharge head, comprising:

preparing a first substrate where a discharge port configured to discharge liquid is formed to face a first surface, a concave portion is formed on a side of a second surface opposite to the first surface, and a first liquid flow passage penetrating from the first surface to the second surface is opened inside the concave portion on the side of the second surface;

preparing a second substrate including a second liquid flow passage opened on a third surface; and sticking the first substrate and the second substrate to communicate the first liquid flow passage with the second liquid flow passage by bonding a bottom face of the concave portion and the third surface with an adhesive agent, wherein the first liquid flow passage includes a first portion on the side of the second surface and a second portion on the side of the first surface, and wherein the processing of the first portion is stopped before the first portion and the second portion communicate with each other, and the concave portion is formed after the processing is stopped.

2. The method of manufacturing a liquid discharge head according to claim 1, wherein the first substrate is a silicon substrate.

3. The method of manufacturing a liquid discharge head according to claim 1, wherein processing of the first portion is performed from the first surface of the first substrate, and processing of the second portion is performed from the second surface of the first substrate.

4. The method of manufacturing a liquid discharge head according to claim 1, wherein the concave portion is formed by wet etching.

5. The method of manufacturing a liquid discharge head according to claim 1, further comprising sticking a third substrate to the first surface of the first substrate.

6. The method of manufacturing a liquid discharge head according to claim 1, further comprising forming, on a surface of the third substrate on a side opposite to the side of the first substrate, a flow passage forming member including the discharge port.

7. The method of manufacturing a liquid discharge head according to claim 6, wherein the third substrate is a silicon substrate.

8. The method of manufacturing a liquid discharge head according to claim 1, wherein the second substrate is made of alumina.

9. A method of manufacturing a liquid discharge head, comprising:

preparing a first substrate where a discharge port configured to discharge liquid is formed to face a first surface, a concave portion is formed on a side of a second surface opposite to the first surface, and a first liquid flow passage penetrating from the first surface to the second surface is opened inside the concave portion on the side of the second surface;

preparing a second substrate including a second liquid flow passage opened on a third surface; and sticking the first substrate and the second substrate to communicate the first liquid flow passage with the second liquid flow passage by bonding a bottom face of the concave portion and the third surface with an adhesive agent, wherein the first liquid flow passage includes a first portion on the side of the second surface and a second portion on the side of the first surface, and wherein a leading hole is formed on the side of the second surface of the first substrate, and the concave portion and the second portion are formed by processing performed from the leading hole.

10. The method of manufacturing a liquid discharge head according to claim 9, wherein the first substrate is a silicon substrate.

11. The method of manufacturing a liquid discharge head according to claim 9, wherein processing of the first portion is performed from the first surface of the first substrate, and processing of the second portion is performed from the second surface of the first substrate.

12. The method of manufacturing a liquid discharge head according to claim 9, wherein the processing of the first portion is stopped before the first portion and the second portion communicate with each other, and the concave portion is formed after the processing is stopped.

13. The method of manufacturing a liquid discharge head according to claim 9, wherein the concave portion is formed by wet etching.

14. The method of manufacturing a liquid discharge head according to claim 9, further comprising sticking a third substrate to the first surface of the first substrate.

15. The method of manufacturing a liquid discharge head according to claim 9, further comprising forming, on a surface of the third substrate on a side opposite to the side of the first substrate, a flow passage forming member including the discharge port.

16. The method of manufacturing a liquid discharge head according to claim 15, wherein the third substrate is a silicon substrate.

17. The method of manufacturing a liquid discharge head according to claim 9, wherein the second substrate is made of alumina.

* * * * *